United States Patent [19]

Sechler et al.

[11] 4,358,714

[45] Nov. 9, 1982

[54] LIGHT DIMMING SYSTEM FOR GROUNDED-SIDE CONTROL OF DISCRETE INDICATOR LAMPS

[75] Inventors: Clark W. Sechler, Cherry Hill, N.J.; Archie T. Sherbert, Jr., Media, Pa.

[73] Assignee: Boeing Vertol Company

[21] Appl. No.: 213,713

[22] Filed: Dec. 5, 1980

[51] Int. Cl.[3] ..... H05B 37/02

[52] U.S. Cl. ..... 315/291; 307/10 LS; 315/77; 315/135; 315/208; 323/349

[58] Field of Search ..... 315/77, 129, 130, 133, 315/135, 208, 291, 307, 311, DIG. 4; 323/349, 905; 307/10 LS

[56] References Cited

U.S. PATENT DOCUMENTS 4,029,991 6/1977 Schultz ..... 315/77 X

FOREIGN PATENT DOCUMENTS 2659658 7/1978 Fed. Rep. of Germany ..... 315/135

1440319 6/1976 United Kingdom ..... 315/291

*Primary Examiner*—Eugene R. La Roche

*Attorney, Agent, or Firm*—Jones, Tullar & Cooper

[57] ABSTRACT

A light dimming system for simultaneously controlling the brightness of a plurality of two-terminal indicating lights, each having one terminal connected to receive a constant voltage relative to ground. The system includes a single dimmer control for producing an arbitrarily variable control voltage, and a like plurality of interface circuits, connected between the dimmer control and the other terminals of the indicating lights, respectively, for varying the voltage at the other terminals of the indicating lights proportional to the control voltage supplied to the interface circuits from the dimmer control.

8 Claims, 1 Drawing Figure

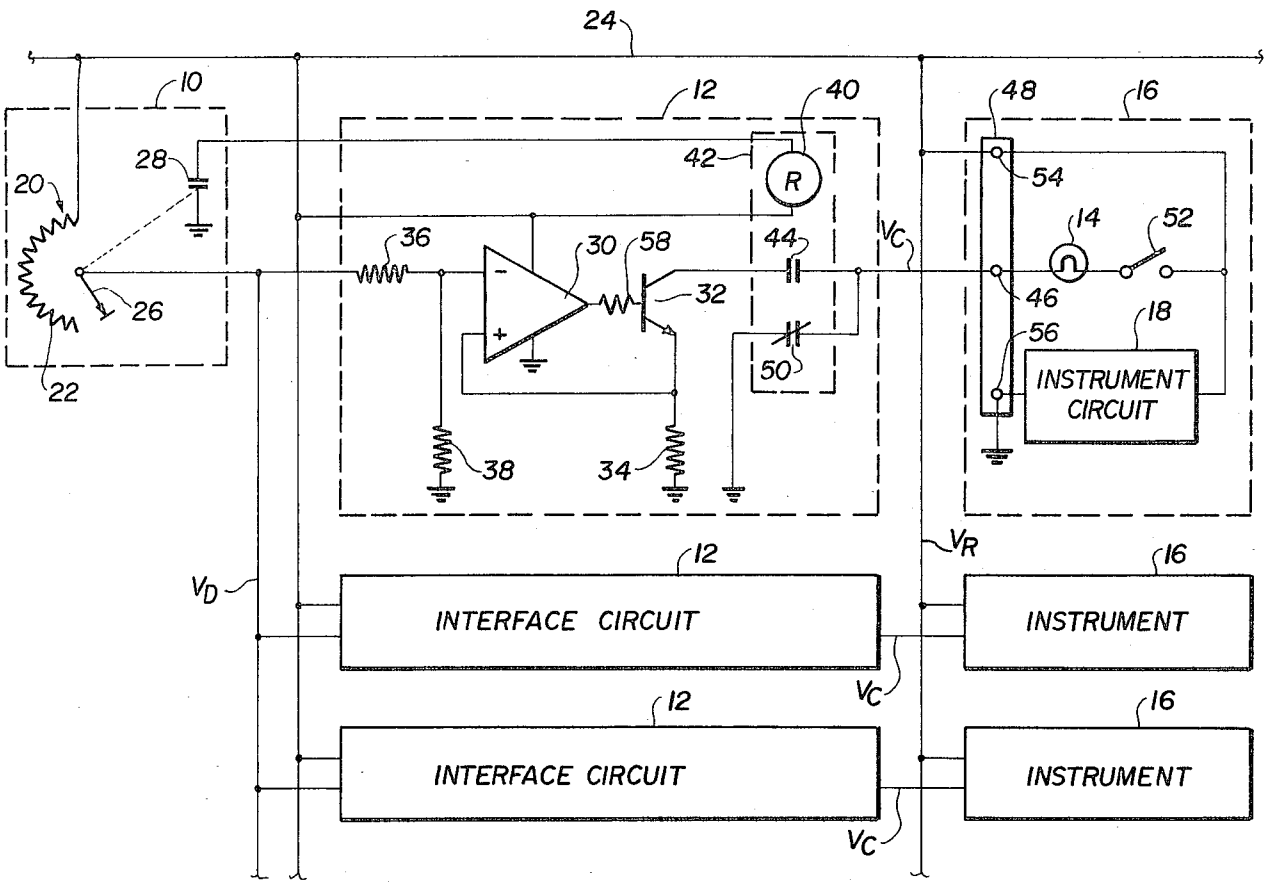
INSTRUMENT CIRCUIT
INSTRUMENT
INSTRUMENT
INTERFACE CIRCUIT
INTERFACE CIRCUIT
$V_R$
$V_C$
$V_C$
$V_C$
$V_D$
R
10
12
12
12
14
16
16
16
18
20
22
24
26
28
30
32
34
36
38
40
42
44
46
48
50
52
54
56
58

LIGHT DIMMING SYSTEM FOR GROUNDED-SIDE CONTROL OF DISCRETE INDICATOR LAMPS

BACKGROUND OF THE INVENTION

This invention relates to light dimming systems, and, more particularly, to an apparatus for simultaneously controlling the brightness of a plurality of discrete indicator lamps.

In aircraft, it is desirable to simultaneously control the brightness of the various annunciator or indicator light-emitting devices, such as incandescent lamps or light-emitting diodes, of the various aircraft instruments, from maximum brightness to completely off, to match the light level of the surrounding environment. Thus, during bright daylight conditions, these indicating lights operate at maximum brightness to insure that they will be readily observed when lit; conversely, under very dark, overcast, night-time conditions, it is desirable that these indicating lights be operated at a very low degree of illumination.

Generally, aircraft instruments are energized by connecting these instruments across a constant direct voltage, generally +28 volts to ground. In many self-contained aircraft instruments, in which various control leads and power leads are brought out to terminal boards or connection plugs, one side of each indicating lamp included in such self-contained instruments is connected to an individual ground line which is brought out to a terminal board or plug, and the other side of the indicating lamp is internally connected through a switching device to a constant voltage dc power line, to which other circuit elements are also internally connected, with only the one constant voltage power line being brought out to the terminal board or plug for connection to an external power supply line. Thus, a light dimming system for simultaneously controlling light intensities of a plurality of indicating lights connected between an energized line and ground, in which only the ground sides of indicating lights are accessible for connection to the dimming system, is highly desirable for use in aircraft.

OBJECTS AND SUMMARY OF THE INVENTION

Therefore, it is an object of the invention to provide a light dimmer system for producing at its output a voltage relative to ground which is arbitrarily variable between predetermined high and low values, to control the intensity of a light connected between the output of the dimmer apparatus and a constant voltage source.

It is a further object of the invention to provide a light dimmer apparatus for simultaneously controlling the light intensities of a plurality of lights having first terminals connected to a constant voltage source and second terminals, connected respectively to the outputs of a like plurality of interface circuits, wherein each interface circuit produces at its output, a voltage relative to ground which is proportional to an arbitrarily variable control voltage supplied to the inputs of all the interface circuits by a single dimmer control circuit.

In a preferred embodiment of the invention, the interface circuit includes an operational amplifier and a ground-emitter transistor connected as a conventional current sink. The collector of the transistor is connected to the ground terminal of an associated indicating light whose other terminal is connected to a constant voltage source. The base of the transistor is connected to the output of the operational amplifier which has an input connected to receive an arbitrarily variable control voltage from a dimmer control circuit. The various components of this circuit are selected such that the voltage at the collector of the transistor is equal to the constant voltage supply minus the control voltage provided by the dimmer control circuit. Thus, the voltage across the indicator light is equal to the control voltage of the dimmer control circuit.

The interface circuit also includes a relay having a normally-open pair of contacts connected between the ground terminal of the indicating light and the transistor collector, and a normally-closed pair of contacts connected between the ground terminal of the indicating light and ground. The relay is controlled by the dimmer control circuit to be energized from the constant voltage supply whenever the dimmer control circuit is connected to control the brightness of the indicating light. When the dimmer control circuit is turned off, the relay is de-energized to disconnect the interface circuit and to connect the ground side of the indicating lamp directly to ground for maximum light intensity.

The invention will be better understood, as well as further objects and advantages will become more apparent, from the ensuing detailed description of a preferred embodiment, taken in conjunction with the drawing.

BRIEF DESCRIPTION OF THE DRAWING

The sole FIGURE is an electrical schematic diagram of a preferred embodiment of the invention.

DESCRIPTION OF THE PREFERRED EMBODIMENT

A dimmer control circuit 10 produces an output voltage $V_D$ which is arbitrarily variable by an operator between predetermined high and low values. This dimmer control voltage $V_D$ is supplied to a plurality of interface circuits 12 which provide output control voltages $V_C$ which are proportional to the dimmer control voltage $V_D$ supplied to the inputs of these interface circuits 12. The output voltage $V_C$ of each interface circuit 12 is supplied to an associated indicating light 14 disposed within the housing 16 of an instrument including an instrument circuit 18.

The dimmer control circuit 10 includes a rheostat 20 having a resistance winding 22, which is connected at one end to a constant positive voltage supply line 24, and a movable contact arm 26, which is movable from a detented OFF position, as shown in the sole FIGURE, to an adjacent FULL DIM position, and from the FULL DIM position through a plurality of intermediate positions along the resistance winding 22 to a FULL BRIGHT position, at which the contact arm 26 engages the end of the resistance winding 22 connected to the supply line 24. At both the OFF and FULL DIM positions, the contact arm 26 is disengaged from the resistance winding 22; at all other positions, the contact arm 26 is slidably engaged with an adjacent portion of the resistance winding 22. The dimmer control circuit 10 also includes a limit switch 28 which is operatively connected to the contact arm 26 to be open only when the contact arm 26 is disposed in its OFF position.

The interface circuit 12 includes an operational amplifier 30 having power supply terminals connected between the constant positive supply line 24 and ground. The output of the operational amplifier 30 is connected to the base of a transistor 32 having an emitter which is connected to the non-inverting input of the operational amplifier 30 and to ground through a small value resistance 34 which serves to limit the total current flowing through lamp 14 to ground through the transistor 32. The inverting input of the operational amplifier 30 is connected through a resistor 36 to the contact arm 26 of the rheostat and through another resistor 28 to ground.

Resistors 36 and 38 provide a voltage dividing network to apply an inverting control voltage, having the proper slope, to the operational amplifier 30. This in turn assures that the voltage drop across the lamp 14 is proportional to the control voltage $V_D$.

The operating coil 40 of a relay 42 is connected between the positive voltage supply line 24 and ground through the limit switch 28 of the dimmer control circuit 10. The relay 42 includes a pair of normally open contacts 44 connected between the collector of the transistor 32 and an indicator light ground terminal 46 of a terminal board or plug 48, carried by the instrument housing 16. Also, the relay 42 includes a pair of normally closed contacts 50 connected between the indicator light ground terminal 46 and ground.

The indicator light 14 is connected through a switching device 52 to a positive voltage line which is brought out to a positive supply terminal 54 of the terminal board 48, which in turn is connected to the positive direct voltage supply line 24. Also, the instrument circuit 18, which is disposed within the housing 16, is connected between the positive input terminal 54 and an instrument ground terminal 56 of the terminal board 48 which in turn is connected to ground.

A resistor 58 is placed in series between the output of the operational amplifier 30 and the base of the transistor 32 to provide spike protection to the transistor and to provide better control of the operational amplifier's input to the transistor.

OPERATION

During operation of the aircraft under bright daylight ambient lighting conditions, the contact arm 26 of the rheostat 20 is disposed in its OFF position, at which it is disconnected from the resistance winding 22. The limit switch 28 is open to thus de-energize the relay 40. The normally open relay contacts 44 are open to disconnect the transistor 32, and the normally closed contacts 50 are closed to connect the indicator light ground terminal 46 directly to ground so that the full supply voltage $V_R$ will be applied across the indicator light 14 whenever the switch device 52 is closed.

As the level of ambient lighting decreases, an operator may move the contact arm 26 of the rheostat 20 to an intermediate position at which the limit switch 28 is closed. The output voltage $V_D$ of the rheostat 20 is supplied through the resistor 36 to the inverting input of the operational amplifier 30 which, with the grounded emitter transistor 32, is connected as a conventional current sink circuit. The various elements 30–38 are selected such that the voltage $V_C$ at the collector of the transistor 32 is equal to the positive supply voltage $V_R$ minus the dimmer control voltage $V_D$.

$$V_C = V_R - V_D$$

Subsequently, whenever the switch device 52 is closed, the voltage appearing across the indicator light 14 is equal to the positive supply voltage $V_R$ minus the voltage $V_C$ at the collector of the transistor 32.

$$V_{light} = V_R - V_C$$

Substituting $V_R - V_D$ for $V_C$ in the above equation, the voltage across the indicator light 14 will be equal to the dimmer control output voltage $V_D$.

$$V_{light} = V_R - (V_R - V_D) = V_D$$

When the contact arm 26 of the rheostat 20 is disposed in one of its intermediate positions, and the line supplying operating voltage $V_R$ to any one of the relays 42 is opened, this relay 42 will be de-energized to open its normally open contacts 44 and close its normally closed contacts 50, to thus connect the indicator light 14 associated with this relay 42 directly across the positive supply voltage and ground for maximum light intensity whenever the switch 52 is closed.

When the contact arm 26 of the rheostat 20 is moved by an operator to the FULL DIM position, the contact arm 26 is disconnected from the resistance winding 22 so that the inverting input of the amplifier 30 is connected to ground through the resistor 38 and the transistor 32 is turned off to reduce current flow through the indicator light 14 to zero.

If the positive voltage supply line 24 supplying operating power to the operational amplifier 30 and the relay 42 of any of the interface circuits 12 is interrupted, the relay 42 affected by this interruption will be de-energized, and the normally closed contact 50 of this relay 42 will close to apply maximum voltage across the indicator light 14 whenever the switch device 52 is closed.

Since it is apparent that many variations, adaptations or modifications can be made to the preferred embodiment of the invention discussed in detail above, it is intended that the scope of this invention be limited only by the appended claims.

What is claimed is:

1. Light dimming apparatus, which comprises:

voltage supply means for supplying a substantially constant supply voltage relative to ground;

dimmer control means, connected to receive the supply voltage, for producing an arbitrarily variable control voltage relative to ground; and at least one light circuit which includes a two terminal, electrically-actuated, light emitter having one terminal connected to receive the supply voltage, and interface circuit, having an input terminal connected to receive the supply voltage, a control terminal connected to receive the control voltage, and an output terminal connected to the other terminal of the light emitter, for producing at its output terminal an output voltage relative to ground which is proportional to the difference of the supply voltage and the control voltage, whereby the voltage across the ligh emitter is proportional to the control voltage.

2. Light dimming apparatus, as described in claim 1, wherein the interface circuit comprises:

an operational amplifier, having operating power terminals connected between the interface circuit input terminal and ground, an inverting input connected to the interface circuit control terminal, a non-inverting input connected to ground, and an output; and a transistor, having a base connected to the output of the operational amplifier, an emitter connected to the non-inverting input of the operational amplifier, and a collector connected to the interface circuit output terminal.

3. Light dimming apparatus, as described in claim 2, wherein the interface circuit further comprises:

a relay having an operating coil connected between the interface circuit input terminal and ground, a normally open pair of contacts connected between the interface circuit output terminal and the transistor collector, and a normally closed pair of contacts connected between the interface circuit output terminal and ground.

4. Light dimming apparatus, as described in claim 3, wherein the dimmer control means includes:

a movable member which is movable to an OFF position; and a limit switch, actuated by the movable member to open only when the movable member is disposed in its OFF position, the limit switch being connected in series with the relay operating coil between the interface circuit input terminal and ground;

whereby, when the movable member is disposed in its OFF position, the limit switch is open, the relay is de-energized, and the interface circuit output terminal is connected to ground through the normally closed pair of relay contacts.

5. Light dimming apparatus, as described in claim 4, wherein the limit switch is connected between the relay coil and ground.

6. Light dimming apparatus, as described in claim 1, wherein each light circuit includes an indicator switch means connected in series with the light emitter between the voltage supply means and the output terminal of the interface circuit for connecting and disconnecting the light emitter from the voltage supply means.

7. Light dimming apparatus, as described in claim 6, wherein the series combination of the light emitter and the indicator switch means of each light circuit is disposed within an instrument housing and is connected to the output terminal of the interface circuit by a connecting line which is brought out of the instrument housing; and the instrument housing includes a power supply line which is connected to the voltage supply means, and an instrument circuit which is connected between the power supply line and ground;

wherein the series combination of the light emitter and the indicator switch means is connected to the power supply line within the instrument housing.

8. Light dimming apparatus, as described in claim 1, wherein the at least one light circuit comprises a plurality of light circuits.

* * * * *

UNITED STATES PATENT AND TRADEMARK OFFICE

CERTIFICATE OF CORRECTION

PATENT NO. : 4,358,714

DATED : November 9, 1982

INVENTOR(S) : CLARK W. SECHLER & ARCHIET. SHERBERT, JR.

It is certified that error appears in the above-identified patent and that said Letters Patent are hereby corrected as shown below:

Column 2, line 58, delete "both" and "and FULL DIM".

Column 3, line 3, delete "non"; line 7, add --non- -- between "The" and "inverting"; line 10, change "28" to --38--; line 12, change "an" to --a--, and delete "inverting control"; line 57, add --non- -- between "the" and "inverting".

Column 4, line 22, delete "FULL DIM" and insert --OFF--; line 24, between "the" and "inverting" insert --non- --; line 61, change "ligh" to --light--; line 67, change "an" to --non- --.

Column 5, lines 1 and 5 delete "non-".

In the drawing, the "+" and "-" signs for element "30" should be reversed.

Signed and Sealed this

*Eleventh* Day of *October 1983*

[SEAL]

*Attest:*

GERALD J. MOSSINGHOFF

*Attesting Officer*

*Commissioner of Patents and Trademarks*